US010760540B2

(12) United States Patent
Yudanov et al.

(10) Patent No.: US 10,760,540 B2
(45) Date of Patent: Sep. 1, 2020

(54) ARRANGEMENT FOR SUPPLYING FUEL TO AN ENGINE

(71) Applicant: VOLVO TRUCK CORPORATION, Gothenburg (SE)

(72) Inventors: Sergi Yudanov, Västra Frölunda (SE); Jan Arnell, Västra Frölunda (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 1166 days.

(21) Appl. No.: 14/654,022

(22) PCT Filed: Dec. 20, 2012

(86) PCT No.: PCT/EP2012/005290
§ 371 (c)(1),
(2) Date: Jun. 19, 2015

(87) PCT Pub. No.: WO2014/094800
PCT Pub. Date: Jun. 26, 2014

(65) Prior Publication Data
US 2015/0330345 A1 Nov. 19, 2015

(51) Int. Cl.
*F02M 55/02* (2006.01)
*F02F 7/00* (2006.01)
*F02M 55/00* (2006.01)

(52) U.S. Cl.
CPC ..... *F02M 55/02* (2013.01); *F02F 7/006* (2013.01); *F02M 55/004* (2013.01);
(Continued)

(58) Field of Classification Search
CPC .... F02M 55/004; F02M 55/005; F02M 55/02; F02M 55/025; F02M 61/14; F02M 61/10;
(Continued)

(56) References Cited

U.S. PATENT DOCUMENTS 1,688,629 A * 10/1928 Schuermann ..... F16L 5/06 126/317
3,402,703 A 9/1968 Dickerson et al.
(Continued)

FOREIGN PATENT DOCUMENTS

EP 0 508 188 A2 10/1992
FR 2859268 A1 * 3/2005 ..... F02M 55/005
(Continued)

OTHER PUBLICATIONS

English machine translation of JP 06147053 A provided by ESPACENET.*
(Continued)

*Primary Examiner* — Jacob M Amick
*Assistant Examiner* — Michael A Kessler
(74) *Attorney, Agent, or Firm* — Venable LLP; Jeffri A. Kaminski

(57) ABSTRACT

An arrangement for supplying fuel from a fuel pressure source located on an outside of an engine enclosure to a fuel injector located on an inside of the engine enclosure includes a fuel pipe for transporting fuel from the fuel pressure source to the fuel injector via an opening in the engine enclosure, and a seal for sealing the fuel pipe at the opening. The seal includes a first part configured for a sealing contact around the fuel pipe and a second part configured for a sealing contact around a sleeve extending around the opening. An internal combustion engine provided with such an arrangement and a method for providing an internal combustion engine with such an arrangement are also provided.

29 Claims, 4 Drawing Sheets

(52) U.S. Cl.
CPC ..... *F02M 55/005* (2013.01); *F02M 55/025* (2013.01); *F02M 2200/16* (2013.01); *Y10T 29/49233* (2015.01)

(58) Field of Classification Search
CPC ..... Y10T 29/49895; Y10T 29/49233; F02F 7/006
USPC ..... 123/456, 468, 469; 285/189–222
See application file for complete search history.

(56) References Cited

U.S. PATENT DOCUMENTS 3,845,748 A * 11/1974 Eisenberg ..... F02M 55/002 123/468
6,070,618 A * 6/2000 Iwabuchi ..... B21C 37/154 138/143
6,233,807 B1 * 5/2001 Werner ..... B23P 19/06 29/407.02
6,394,071 B2 * 5/2002 Nitta ..... F02F 7/006 123/456
6,886,537 B2 * 5/2005 Kondo ..... F02M 55/005 123/456
2010/0183363 A1 * 7/2010 Bartholoma ..... F16L 5/02 403/259

FOREIGN PATENT DOCUMENTS

JP 62101879 A * 5/1987 ..... F02M 55/005
JP 06147053 A * 5/1994 ..... F02F 7/006
JP 2002 089407 A 3/2002

OTHER PUBLICATIONS

International Search Report (dated Apr. 5, 2013) for corresponding International App. PCT/EP2012/005290.

* cited by examiner

ARRANGEMENT FOR SUPPLYING FUEL TO AN ENGINE

BACKGROUND AND SUMMARY

This invention relates to an arrangement for supplying fuel from a fuel pressure source located on an outside of an engine enclosure to a fuel injector located on an inside of the engine enclosure. The invention also relates to an internal combustion engine provided with such an arrangement and a method for providing an internal combustion engine with such a fuel supply arrangement.

Cost efficiency important in the production of internal combustion engines. One of the steps in the production, at least for diesel engines and similar, is the installation of the fuel injection equipment. The components forming part of such equipment can be complicated and rather expensive, and the equipment can also be complicated and costly to install.

In certain cases, it is necessary to install the fuel injection equipment on an engine such that the source of fuel pressure is located outside the engine whilst the injector receiving the pressurised fuel is located inside the engine, i.e. in a volume inside an engine enclosure subjected to crankcase pressure and the flow of engine oil. Supply of fuel is then needed from the outside to the inside of the engine. A problem with such an installation type is bow to ensure a reliable but cost-effective and simple-to-install seal that seals off the engine-internal volume from the ambient at the point where a fuel pipe or similar enters the internal engine volume.

U.S. Pat. No. 6,394,071 shows an example of a fuel supply system where the cost and complexity is presented to be reduced compared to prior art. The system of U.S. Pat. No. 6,394,071 is, however, still relatively complex containing a number of different fuel pipes etc. Moreover, there has not been paid much intention to the complexity of the installation process.

There is still a need for less complex and less costly fuel injection equipment and for more cost efficient methods for assembling the equipment and installing it onto the engine.

It is desirable to provide a fuel supply system that provides for a more cost efficient production compared to conventional systems.

The invention, according to an aspect thereof, concerns an arrangement for supplying fuel from a fuel pressure source located on an outside of an engine enclosure to a fuel injector located on an inside of the engine enclosure. The arrangement comprises: a fuel pipe for transporting fuel from the fuel pressure source to the fuel injector via an opening in the engine enclosure and a seal for sealing the fuel pipe at the opening.

The invention, according to an aspect thereof, is characterized in that the seal comprises a first part configured for a sealing contact around the fuel pipe and a second part configured for a sealing contact around a sleeve extending around the opening.

Such an arrangement has the advantage that it provides for a proper sealing also when the opening in the engine enclosure, typically in the cylinder head cover, is significantly larger than the fuel pipe, i.e. when the diameter of the opening is much larger than the diameter of the fuel pipe so that a significant void is formed in the radial direction between the pipe and the edge of the opening. In such a situation a conventional sealing adapted for small gaps cannot be used.

An effect of the inventive arrangement is that it allows for the use of fuel pipes in the form of a regular pipe with a fastening device, such as a pipe nut and a cold-formed cone end, pre-installed at each pipe end. The cross sectional dimension of the fastening device of such standard pipes is larger than that of the actual pipe. Such pipes thus require a larger opening in the engine enclosure for its introduction towards the fuel injector and a larger opening require a special sealing solution. Preferably, the seal is pre-installed onto the fuel pipe and, suitably, this is done before forming the ends and installing the pipe nuts so as to allow the seal to be easily slipped onto the pipe. The use of regular pipes with e.g. pipe nuts lowers the cost of the components and makes it possible to simplify the design of the fuel supply system.

A further advantageous effect of an aspect of the invention is that the connection of the pressure source with the pressure receiving apparatus (typically the fuel injector) can be accomplished using a single continuous pipe without intermediate hydraulic connections. This reduces the costs and improves reliability and durability of the high-pressure line between the source and receiver of the pressure.

A further effect of an aspect of the inventive arrangement is that the assembling of the fuel supply system is simplified, see below. This enhances the cost efficiency of the production.

In an embodiment of the invention the arrangement further comprises a flexible element configured to lock the second part of the seal in its intended position around the sleeve. Preferably, the flexible element comprises a resilient closed loop capable of pressing the second part of the seal towards an outer circumference of the sleeve. Preferably, the flexible element comprises a metal spring. This provides for an easy installation and a secure way of locking the second part of the seal, in particular if the sleeve is provided with a groove for holding the flexible element and preferably also the seal in place.

In an embodiment of the invention the first part of the seal is slidably mounted onto the fuel pipe. This way the seal can easily be slided along the pipe into place with its second part around the sleeve after having properly positioned the fuel pipe (e.g. by fastening it to the fuel injector). Preferably, the arrangement comprises a second flexible element, such as a closed metal spring loop, configured to press the first part of the seal towards the fuel pipe.

The use of such a flexible element for the first part of the seal, preferably pre-assembled with the pipe, allows improving slideability of the seal along the pipe whilst providing the required squeeze in as-mounted state for reliable and durable sealing between the seal and the pipe body.

In an embodiment of the invention an inner portion of the second part of the seal is adapted to the outer dimensions of the sleeve and that an inner portion of the first part of the seal is adapted to the outer dimensions of the fuel pipe, wherein the cross section of the inner portion of the second part is significantly larger than the cross section of the inner portion of the first part of the seal. This provides for a proper seal to both the sleeve and the pipe where the sleeve has a larger cross-section than the pipe.

Preferably, the seal forms a single piece of material that surrounds the pipe when mounted onto the pipe. This lowers the risk of leakage. Preferably, the seal is made of an elastomeric material.

In an embodiment of the invention the seal is pre-installed onto the fuel pipe which, preferably, is provided with a pre-installed fastening device, such as a cone-shaped pipe end and a pipe nut, at its end intended to be connected to the fuel injector and a further pre-installed fastening device (or other detail that prevents easy post-installation of seal onto complete pipe, such as a branched fitting) at its end intended to remain outside of the engine enclosure.

Such a combined product, i.e. seal pre-installed on pipe with pipe nuts (or other fastening device) at both ends, forms a ready-to-use product that provides for efficient handling (it can e.g. be purchased as a ready-to-use product) and can be installed in an efficient way on the engine.

The invention also concerns an internal combustion engine comprising an engine enclosure, a fuel receiving component such as a fuel injector located inside the engine enclosure and an opening in the engine enclosure. The inventive engine comprises a sleeve extending around the opening and a fuel supply arrangement as described above.

In an embodiment of the inventive engine the sleeve has a circular cross section and is positioned on an outside of the engine enclosure. Preferably, the sleeve is provided with a groove configured to hold the second part of the seal and/or the flexible element in place. This provides for a secure locking of the seal.

Preferably, the cross section of the opening is significantly larger than the outer cross section of the fuel pipe. This allows a standard pipe with a pre-installed pipe nut or similar to be inserted through the opening and thus provides for the use of such pipes.

In an embodiment of the inventive engine one end of the fuel pipe is connected to the fuel injector and the other end to a fuel pressure source located outside of the engine enclosure. Preferably, the fuel pressure source is a common rail in fluid communication with at least one further fuel injector, i.e. the common rail extends along the engine. The inventive concept is particularly advantageous for such a fuel supply system. Preferably, the engine enclosure comprises a cylinder head cover, wherein the opening is arranged in the cylinder bead cover. Preferably, the openings are arranged in a lower part of the cylinder head cover, wherein an upper part of the cover is removable to allow access to fastening device at the fuel injector.

The invention also concerns a method for providing an internal combustion engine with a fuel supply arrangement comprising a fuel pipe for transporting fuel from a fuel pressure source located outside an engine enclosure to a fuel injector located inside the engine enclosure.

The inventive method comprises the steps of providing a fuel pipe provided with a seal having a first part configured for a sealing contact around the fuel pipe and a second part configured for a sealing contact around a sleeve extending around art opening in the engine enclosure, wherein the seal is movable along the fuel pipe; introducing an injector end of the fuel pipe through the opening and positioning the fuel pipe; moving the seal relative to the fuel pipe to a position in which the second part of the seal is positioned around and in contact with the sleeve.

Such a method makes the installation procedure efficient and much less complex than described in, for instance, U.S. Pat. No. 6,394,071.

The inventive method can include one or several of the following:

providing a flexible element configured to lock the second part of the seal in its intended position around the sleeve; and arranging the flexible element around the sleeve and the second part of the sealing, connecting the injector end of the fuel pipe to the fuel injector, connecting an outer end of the fuel pipe to a fuel pressure source located outside of the engine enclosure, wherein at least the injector end of the fuel pipe is provided with a pre-installed fastening device, such as a coned end and a pipe nut (which has a larger cross sectional dimension than the fuel pipe), wherein the flexible element comprises a resilient closed loop capable of pressing the second part of the seal towards an outer circumference of the sleeve, the method comprising the steps of: providing the flexible element around the fuel pipe or the sleeve and; moving the flexible element relative to the fuel pipe to its position in which it locks the second part of the seal around the sleeve, and/or positioning the seal around the fuel pipe and providing each end of the fuel pipe with fastening device.

In the last step a ready-to-use pipe-seal component is formed, which step may be carried out at another location by e.g. a subcontractor.

BRIEF DESCRIPTION OF DRAWINGS

In the description of the invention given below reference is made to the following figures, in which.

DETAILED DESCRIPTION

Figure 1:
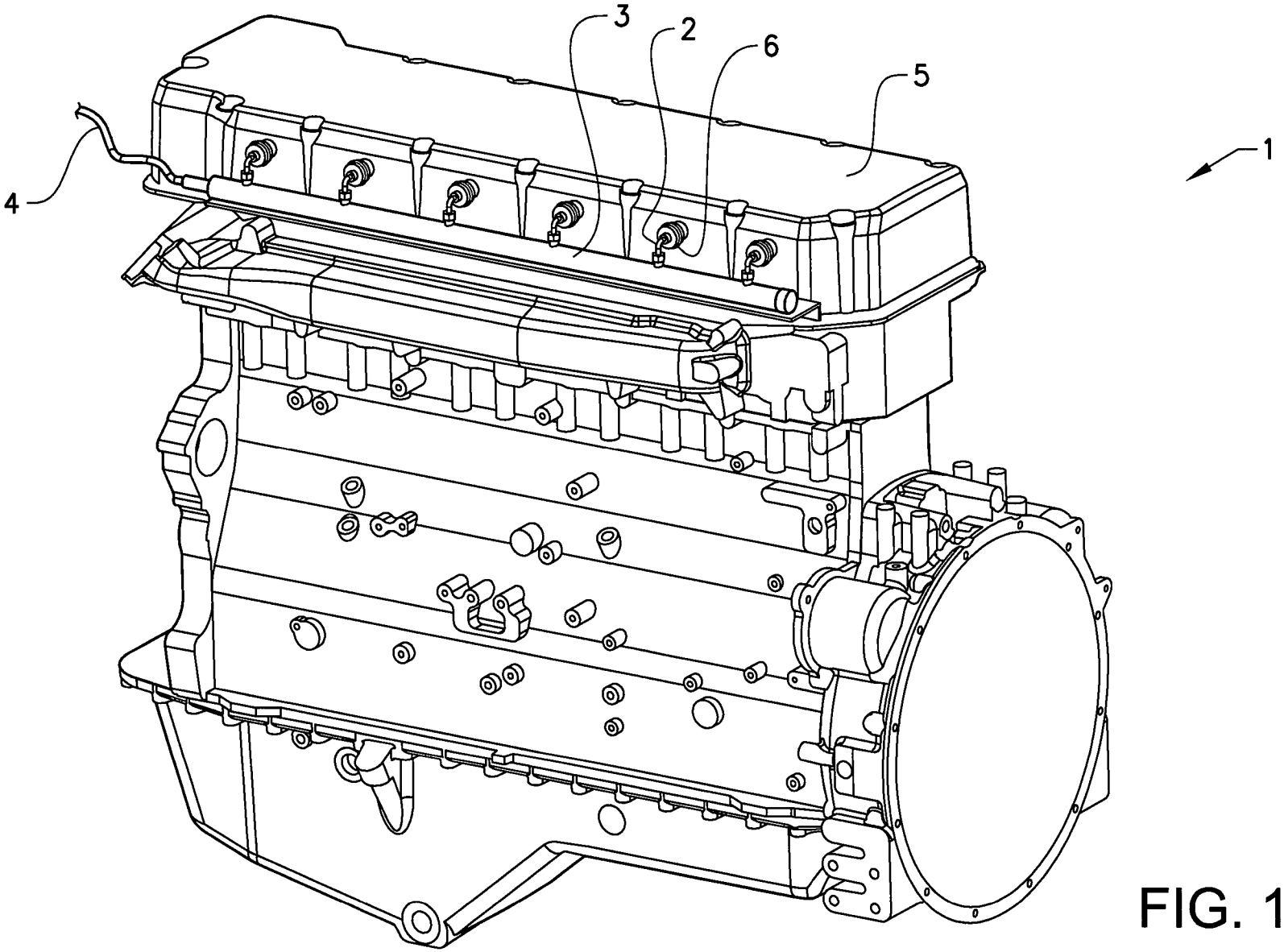
FIG. 1 shows, in a perspective view, an engine provided with a first embodiment of the inventive fuel supply arrangement.
Figure 2:
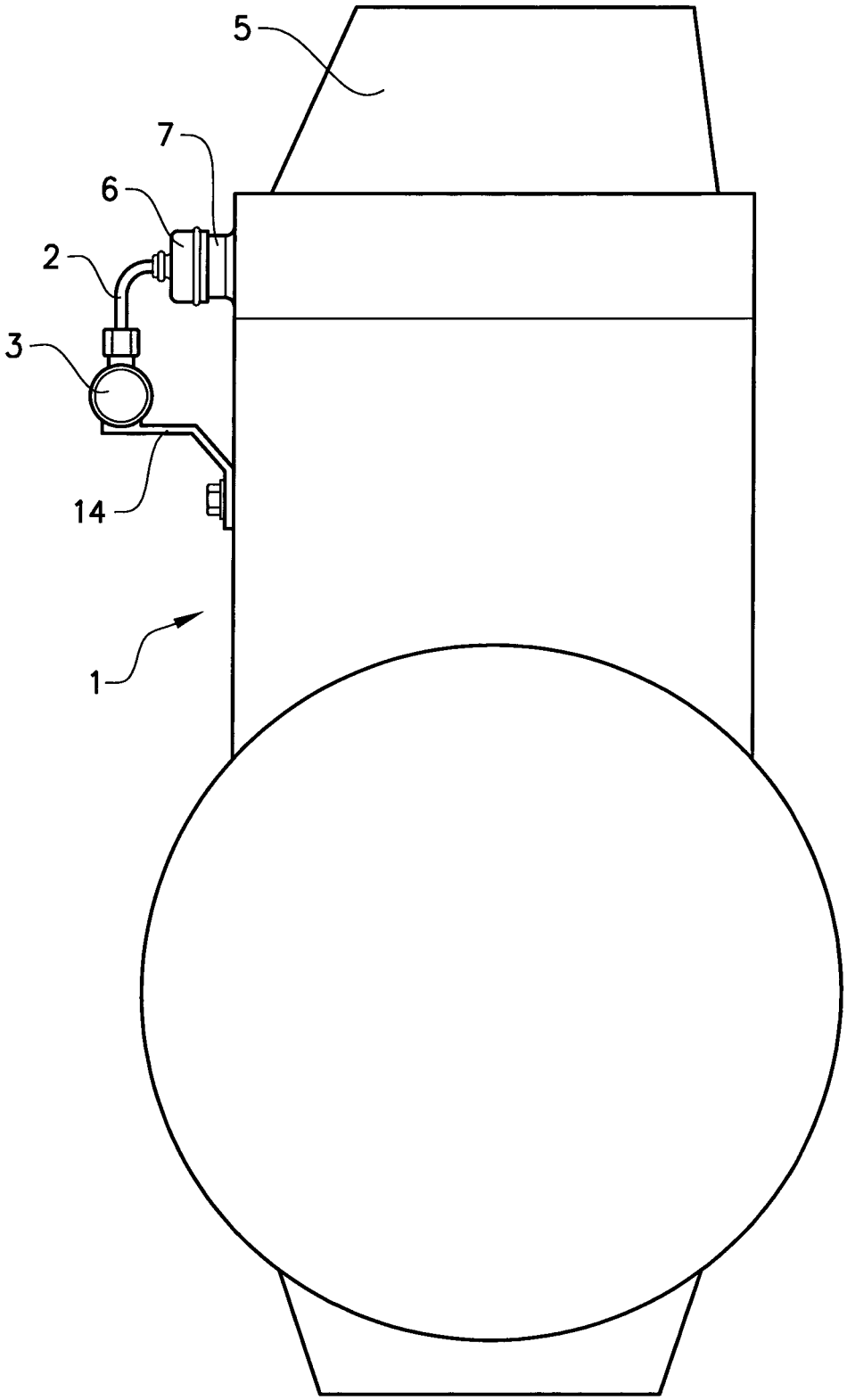
FIG. 2 shows a schematic rear view of the engine according to FIG. 1.
Figure 3:
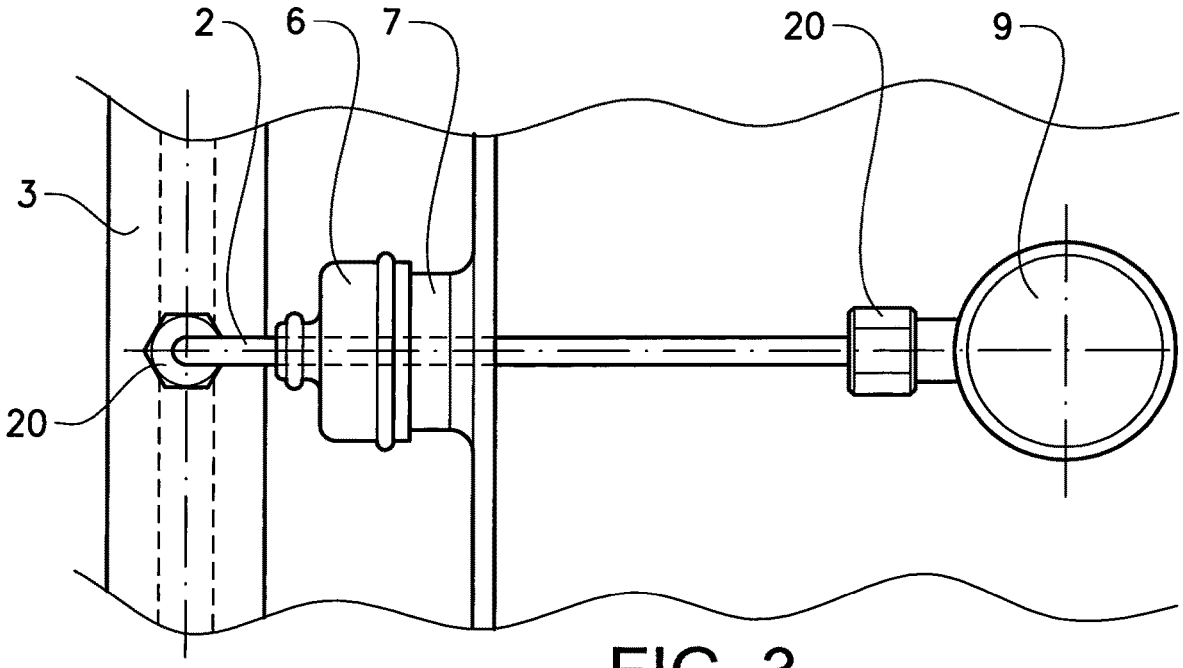
FIG. 3 shows a top view of a detail in FIG. 2 with the valve cover removed.

FIG. 1 shows an internal combustion engine 1 provided with a first embodiment of the inventive fuel supply arrangement. The engine 1 comprises an engine enclosure 5 including a cylinder head cover/valve cover, a fuel injector 9 (see FIGS. 3-7) located inside the engine enclosure 5, an opening 10 (see FIGS. 4-7) in the engine enclosure 5, a sleeve 7 (see FIGS. 4-7) extending around the opening 10 on an outside of the engine enclosure 5, and a fuel supply arrangement.

The fuel supply arrangement is intended to supply fuel from a fuel pressure source in the form a common rail 3 located on an outside of the engine enclosure 5 to the fuel injector 9. As shown in the figures the fuel supply arrangement comprises a fuel pipe 2 for transporting fuel from the fuel pressure source 3 to the fuel injector 9 via the opening 10 in the engine enclosure 5. The fuel supply arrangement further comprises a seal 6 for sealing the fuel pipe 2 at the opening 10.

The common rail 3 is in fluid communication with further fuel supply arrangements and corresponding fuel injectors, in this example six identical fuel supply arrangements/fuel injectors. A fuel connector 4 connects the common rail 3 with e.g. a fuel pump (not shown).

Each end of the pipe 2 is provided with a pre-installed fastening device that in this example comprises a cone-shaped end 21 and a pipe nut 20 (see FIG. 5) for connection to the fuel injector 9 and the common rail 3, respectively.

Figure 4:
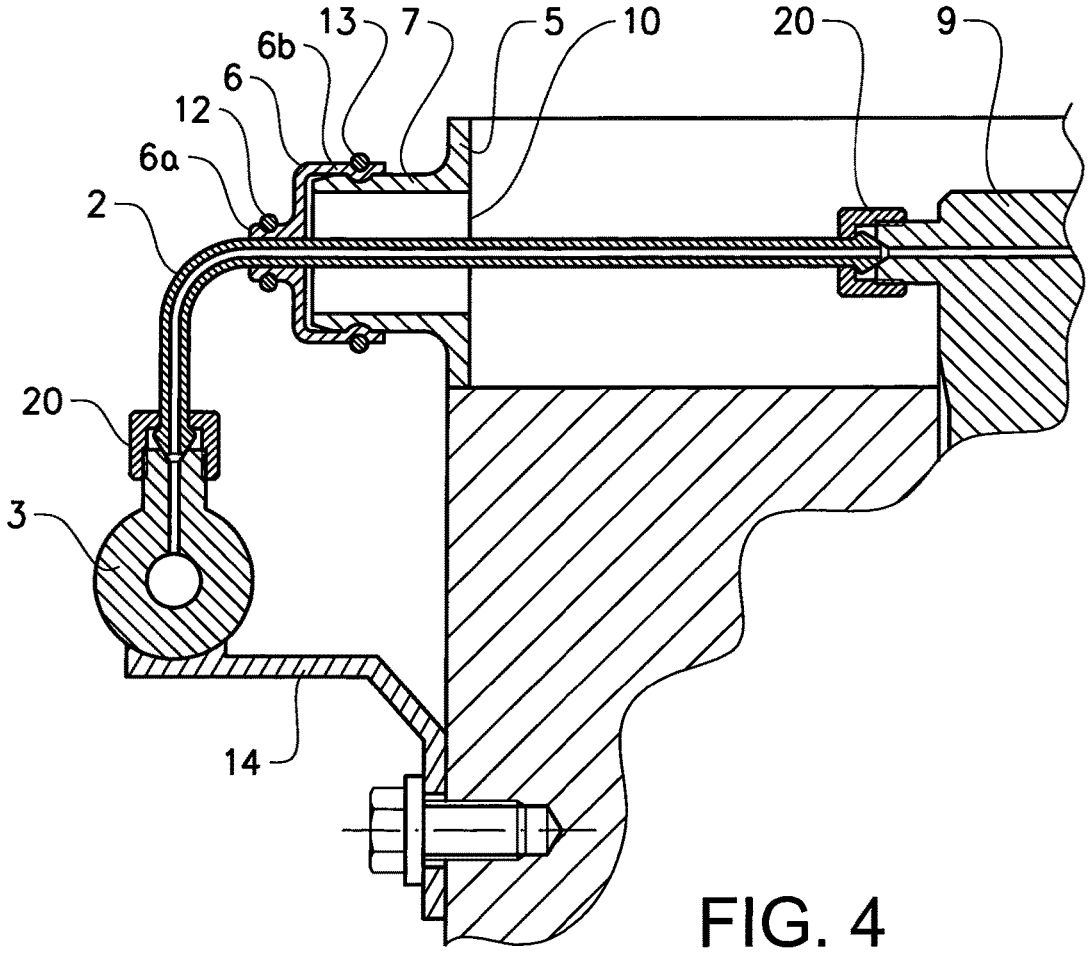
FIG. 4 shows, in a sectional view along the fuel pipe, a rear view of the detail in FIG. 3, and FIGS. 5-7 show the installation of the inventive arrangement onto the engine.

As shown more clearly in FIG. 4, the seal 6 comprises a narrow first part **6*a* configured for a sealing contact around the fuel pipe 2 and a wider second part 6*b* configured for a sealing contact around the sleeve 7 extending around the opening 10. Both the sleeve 7 and the pipe 2 have a circular cross section, and the diameter of the sleeve 7 is considerably larger than the diameter of the pipe 2. A cylindrical inner portion of the second part 6***b* of the seal 6 is adapted to the outer dimensions of the sleeve 7 and a cylindrical inner portion of the first part 6*a* of the seal 6 is adapted to the outer dimensions of the fuel pipe 2.

The opening 10, which in this example also has a circular cross section, is much larger than the cross sectional dimension of the fuel pipe 2 and larger than that of the pipe nuts 20 to allow the pipe nut 20 to be inserted through the opening 10.

As shown in e.g. FIG. 4 the fuel supply arrangement further comprises a flexible element 13 comprising a closed metal spring loop configured to lock the second part 6*b* of the seal 6 in its intended position around the sleeve 7. A similar flexible element 12 configured to press the first part 6*a* of the seal 6 against the pipe 2 is also provided. Such flexible elements 12, 13 are sometimes referred to as concentric energizing rings.

As shown in FIGS. 4-7 the sleeve 7 is provided with a groove 7*a* that extends circumferentially around the sleeve 7 on the outside thereof. Further, the second part 6*b* of the seal 6 has on its inside a circumferentially extending protrusion 16*b* that fits into the groove 7*a* and on its outside, radially outside of the protrusion 16*b*, a circumferentially extending groove 16*a* adapted to receive (a part of) the flexible element 13. Together this forms as type of double snap-lock function; the second part 6*b* of the seal 6 is snapped onto the sleeve 7 and the flexible element 13 is snapped onto the second part 6*b* of the seal 6. This provides for an easy installation and a secure sealing. The cross-section diameter of the protrusion 16*b* can be made slightly larger than the corresponding diameter of the cross-section of the groove 7*a*, such that the second part 6*b* of the seal 6 is wedged into the groove 7*a* to achieve higher contact pressure between the seal 6 and the sleeve 7 for as more reliable and durable sealing performance.

The groove 16*a* and protrusion 16*b* of the second part 6*b* of the seal 6 could be dispensed with if the seal 6 is sufficiently flexible to allow the flexible element 13 to press the seal material into the sleeve groove 7*a* and lock the second part 6*b* of the seal 6 that way. In any case, the sleeve groove 7*a* is configured to hold the second part 6*b* of the seal 6 and/or the flexible element 13 in place.

A similar groove is arranged on an outside of the first part 6*a* of the seal 6 to hold the further flexible element 12 in place. However, as to the first part 6*a* of the seal there is no inner groove arranged in the pipe 2 since the seal is intended to be slidably moveable along the pipe 2 for installation purposes as described below.

The fuel pipe 2 and the seal 6 form a prefabricated component where the seal 6 and the smaller flexible element 12 are already mounted onto and around the pipe 2 and where the pipe nuts 20 and the cone-shaped ends 21 are already pre-installed.

A supporting member 14 connects the common rail 3 to the engine 1.

Figure 5:
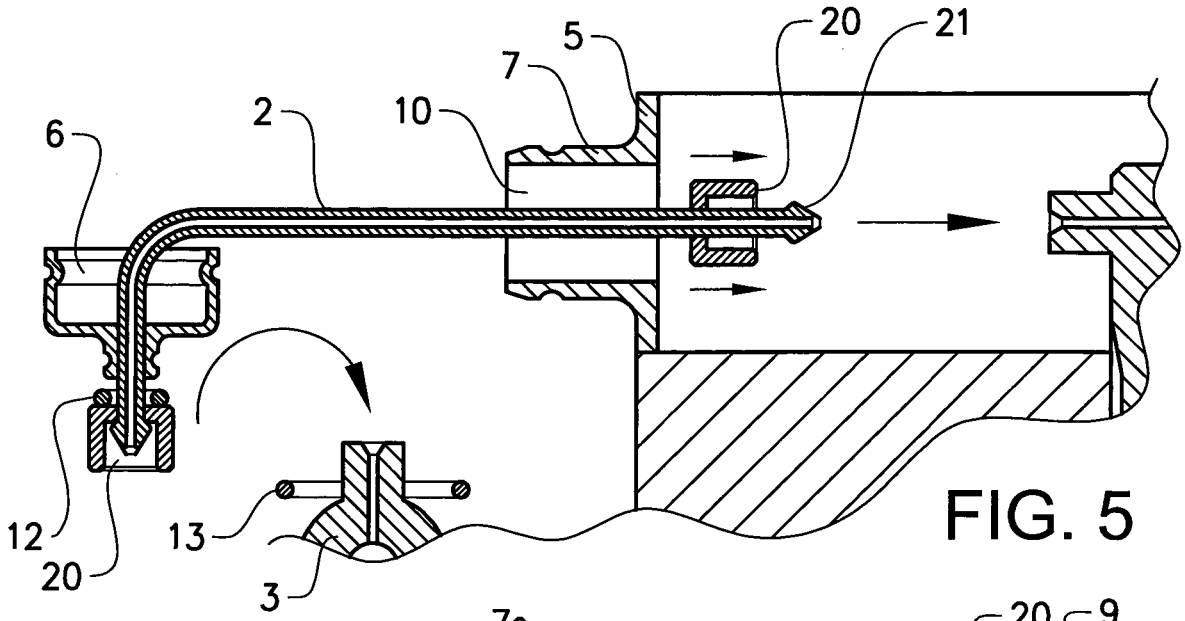
Figure 6:
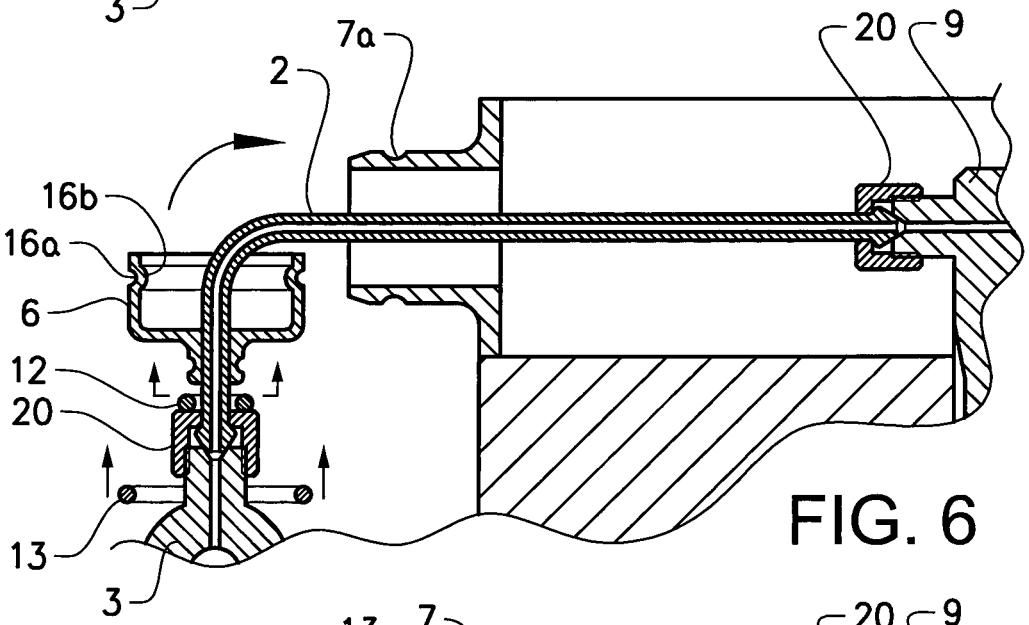
Figure 7:
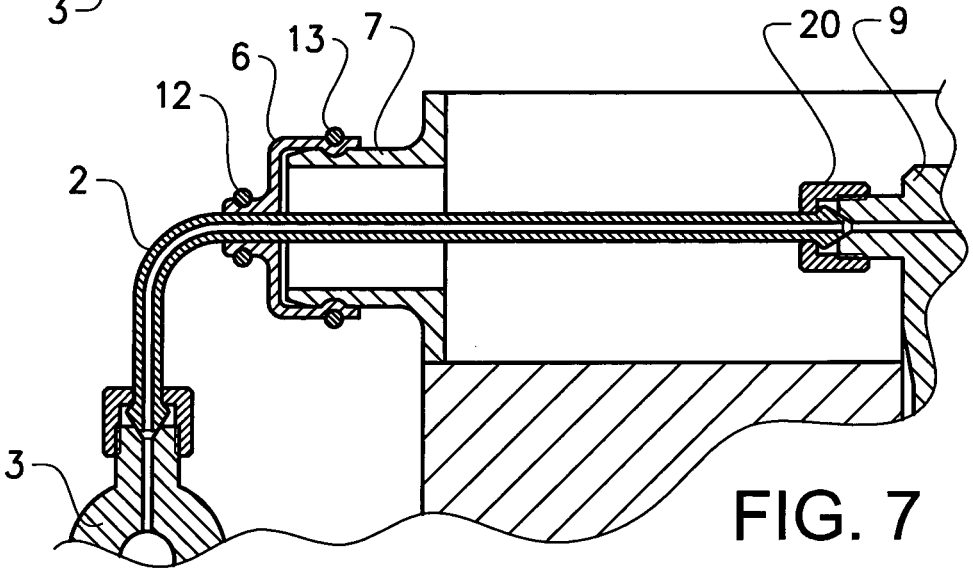

FIGS. 5-7 shows an exemplified method for providing the internal combustion engine 1 with the fuel supply arrangement described above.

In FIG. 5 the injector end of the pipe 2 with the corresponding pipe nut 20 has been inserted through the opening 10 inside of the sleeve 7. The seal 6 is arranged onto and around the pipe 2 between the pipe nuts 20 and is kept outside of the enclosure 5.

The closed loop flexible element 13 for locking the second pan 6*b* of the seal 6 to the sleeve 7 has been arranged around a connecting part of the common rail 3 as to be properly placed around the pipe 2 when the pipe 2 has been connected. Alternatively, the flexible member 13 can initially be positioned around the pipe 2, e.g. in place (at the groove 16*a*) around the second part 6*b* of the seal 6, or around the sleeve 7. The further closed loop flexible element 12 intended to press the first part 6*a* of the seal 6 towards the pipe 2 is positioned around the pipe 2 close to the outer pipe nut 20. Alternatively, it can be positioned in place around the first part 6*a* of the seal 6.

In FIG. 6 the fuel pipe 2 has been properly positioned by connecting it to the fuel injector 9 and the common rail 3 using the pipe nuts 20. An upper part of the enclosure 5 is removable to allow easy access to the pipe nut 20 at the injector 9 for connecting the pipe nut 20 (and for tightening the pipe nut 20 properly, which can be done in a later step). In this case the valve cover comprises two parts: a lower part provided with the openings 10 an upper removable part. This allows the pipe 2 to be properly connected, tightened and leakage-tested before finishing the assembly by fastening the upper part of the cover onto the engine 1.

The seal 6 can now be slid along the pipe 2 towards the opening 10 and be properly placed around the sleeve 7. If the flexible elements 12, 13 were not properly positioned around the seal 6 already in a previous step, they can now be snapped in place around the seal 6 by moving them along the pipe 2.

FIG. 7 shows the seal 6 properly locked onto the sleeve 7.

The steps of positioning the seal 6 around the fuel pipe and providing each end of the fuel pipe 2 with a fastening device 20, 21 is preferably not included in the installation process but form part of a prefabrication method. The flexible members 12, 13 can be pre-installed onto the seal 6 or simply form part of a starting kit for installation of the fuel supply arrangement at the engine 1. The actual installation can thereby start with the step of inserting the inner end of the pipe 2 through the opening 10, or possibly by positioning the flexible elements 12, 13 around the pipe 2, the sleeve 7 or the connecting part of the common rail 3.

The invention is not limited by the embodiments described above but can be modified in various ways within the scope of the claims.

For instance, other type of pipe can be used, for example a plain-ended pipe which uses ferrules that get swaged in to the pipe during tightening of the pipe nuts. The combination of pipe/ferrule/pipe nut/seal with the flexible elements then becomes difficult to dissemble, but this still gives the possibility of completely separating the pipe from the engine during maintenance.

Also, the seal 6 could be used without the flexible elements 12, 13 in case the material of the seal is durable enough to maintain leakage-free operation on its own. Alternatively, several flexible elements 12, 13 can be used at both larger and smaller ends of the seal 6, and several grooves may be provided to receive the flexible elements, also for increased reliability and durability.

It is preferred to utilize in the fuel injection equipment of engines the high-pressure fuel pipes with cold-formed cone-shaped ends and pipe nuts that are put over the pipe before its ends are formed. Such pipes are relatively simple in construction and manufacture but offer high strength and durability due to absence of stress-concentrators that make other types of pipe ends vulnerable to vibration and instability of internal pressure.

The invention claimed is:

1. An arrangement for supplying fuel from a fuel pressure source located on an outside of an engine enclosure to a fuel injector located on an inside of the engine enclosure, the arrangement comprising: a fuel pipe for transporting fuel from the fuel pressure source to the fuel injector via an opening in the engine enclosure, wherein the fuel pipe is a separate component from the fuel injector, and wherein the fuel pipe is connectable to the fuel injector by a fastening device located at an injector end of the fuel pipe; a seal for sealing the fuel pipe at the opening, wherein the seal comprises a first part configured for a sealing contact around an outer exterior circumferential surface of the fuel pipe and a second part configured for a sealing contact around a sleeve, the sleeve extending around the opening, wherein the first part of the seal is slidably mounted onto the fuel pipe.

2. Arrangement according to claim 1, wherein the arrangement further comprises a flexible element configured to lock the second part of the seal around the sleeve.

3. Arrangement according to claim 2, wherein the flexible element comprises a resilient dosed loop capable of pressing the second part of the seal towards an outer circumference of the sleeve.

4. Arrangement according to claim 2, wherein the flexible element comprises a metal spring.

5. Arrangement according to claim 2, wherein the arrangement comprises a second flexible element configured to press the first part of the seal towards the fuel pipe.

6. Arrangement according to claim 1, wherein an inner portion of the second part of the seal is adapted to the outer dimensions of the sleeve and an inner portion of the first part of the seal is adapted to the outer dimensions of the fuel pipe, wherein a cross section of the inner portion of the second part is larger than a cross section of the inner portion of the first part of the seal.

7. Arrangement according to claim 1, wherein the seal forms a single piece of material.

8. Arrangement according to claim 1, wherein the seal is made of an elastomeric material.

9. Arrangement according to claim 1, wherein the seal is mounted onto the fuel pipe.

10. Arrangement according to claim 1, wherein the fuel pipe is provided with a fastening device at an end of the fuel pipe for being disposed outside of the engine enclosure.

11. Arrangement according to claim 1, wherein the fastening device comprises a cone-shaped pipe end and a pipe nut.

12. An internal combustion engine comprising the fuel supply arrangement according to claim 1, the engine enclosure, the fuel injector located inside the engine enclosure, the opening in the engine enclosure, and the sleeve extending around the opening.

13. Engine according to claim 12, wherein the sleeve has a circular cross section.

14. Engine according to claim 12, wherein the sleeve is provided with a groove configured to hold the second part of the seal and/or the flexible element in place.

15. Engine according to claim 12, wherein the sleeve is positioned on an outside of the engine enclosure.

16. Engine according to claim 12, wherein the cross section of the opening is larger than the outer cross section of the fuel pipe.

17. Engine according to claim 12, wherein the fuel pipe is connected to the fuel injector.

18. Engine according to claim 12, wherein the fuel pipe is connected to a fuel pressure source located outside of the engine enclosure.

19. Engine according to claim 18, wherein the fuel pressure source is a common rail in fluid communication with at least one further fuel injector.

20. Engine according to claim 12, wherein the engine enclosure comprises a cylinder head cover, wherein the opening is arranged in the cylinder head cover.

21. Engine according to claim 20, wherein the opening is arranged in a lower part of the cylinder head cover and wherein in upper part of the cylinder head cover is removable to allow access to a fastening device used for connecting the fuel pipe to the fuel injector.

22. A method for providing an internal combustion engine with a fuel supply arrangement comprising a fuel pipe for transporting fuel from a fuel pressure source located outside an engine enclosure to a fuel injector located inside the engine enclosure, wherein the fuel pipe is separate from the fuel injector, and wherein the fuel pipe is connectable to the fuel injector by a fastening device located at an injector end of the fuel pipe, the method comprising the steps of: providing a fuel pipe provided with a seal having a first part configured for a sealing contact around an outer exterior circumferential surface of the fuel pipe and a second part configured for a sealing contact around a sleeve extending around an opening in the engine enclosure, wherein the seal is movable along the fuel pipe, introducing the injector end of the fuel pipe through the opening and positioning the fuel pipe, and moving the seal relative to the fuel pipe to a position in which the second part of the seal is positioned around and in contact with the sleeve.

23. Method according to claim 22, wherein the method further comprises:

providing a flexible element configured to lock the second part of the seal around the sleeve, and arranging the flexible element around the sleeve and the second part of the seal.

24. Method according to claim 22, wherein the method further comprises the step of connecting the injector end of the fuel pipe to the fuel injector.

25. Method according to claim 22, wherein the method further comprises the step of connecting an outer end of the fuel pipe to a fuel pressure source located outside of the engine enclosure.

26. Method according to claim 23, wherein the flexible element comprises a resilient closed loop capable of pressing the second part of the seal towards an outer circumference of the sleeve, the method further comprising the steps of: providing the flexible element around the fuel pipe or the sleeve, and: moving the flexible element relative to the fuel pipe to its position in which it locks the second part of the seal around the sleeve.

27. Method according to claim 22, wherein the method further comprises: positioning the seal around the fuel pipe and providing each end of the fuel pipe with a fastening device for connection of the pipe to the fuel injector and the fuel pressure source, respectively.

28. Arrangement according to claim 1, wherein the seal is on an exterior of the engine enclosure.

29. Method according to claim 22, wherein the seal is on an exterior of the engine enclosure.

* * * * *